United States Patent [19]

Schuster

[11] 4,394,797

[45] Jul. 26, 1983

[54] COVER FOR A RIFLE SIGHT

[76] Inventor: Ronald D. Schuster, P.O. Box 92, Claremont, Minn. 55924

[21] Appl. No.: 334,583

[22] Filed: Dec. 28, 1981

[51] Int. Cl.[3] ..... F41G 1/04

[52] U.S. Cl. ..... 33/244; 42/15

[58] Field of Search ..... 42/1 R, 1 N, 83, 1 S, 42/1 ST; 33/244

[56] References Cited

U.S. PATENT DOCUMENTS

| | | | |
|---|---|---|---|
| 625,581 | 5/1899 | Mason | 33/244 |
| 660,361 | 10/1900 | Candrian | 33/244 |
| 1,560,322 | 11/1925 | Roberts | 33/244 X |
| 2,545,473 | 3/1951 | Kremkau | 42/1 |
| 2,558,792 | 7/1951 | Snowden | 42/1 |
| 3,063,184 | 11/1962 | Sukala, Jr. | 42/1 |
| 3,354,569 | 11/1967 | Kassabian | 42/1 |

FOREIGN PATENT DOCUMENTS

| | | | |
|---|---|---|---|
| 2843 | of 1885 | United Kingdom | 33/244 |
| 4840 | of 1886 | United Kingdom | 33/244 |
| 3548 | of 1897 | United Kingdom | 33/244 |
| 19933 | of 1904 | United Kingdom | 33/244 |

*Primary Examiner*—Harry N. Haroian

*Attorney, Agent, or Firm*—Wicks & Nemer

[57] ABSTRACT

A cover for a rifle sight including a substantially hollow elongated body open at the bottom along a pair of first and second parallely disposed side portions, each side portion having a lowermost wall portion arcuately formed transversely of the elongated body for clamping engagement of a gun barrel. The first and second sides each terminate at a portion thereof in an enlarged forward portion on each side of the first and second sides with the enlarged forward portions connected at the upper edges thereof and the forward portions terminate in an arcuately formed forward end wall and the rearward portions terminate in an arcuately formed rear end wall.

1 Claim, 7 Drawing Figures

COVER FOR A RIFLE SIGHT

SUMMARY

The invention relates generally to rifle sights and the maintenance thereof and more particular to a cover for a rifle sight which mounts on the barrel.

It is an object of the invention to provide a one-piece cover for a rifle sight which is easily and simply mounted to a secure position on the barrel and over the sight. It is also an object of the invention to provide a cover for a rifle sight which allows a rifle to be slipped into and out of a gun case without the sight tearing the inside of the gun case.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
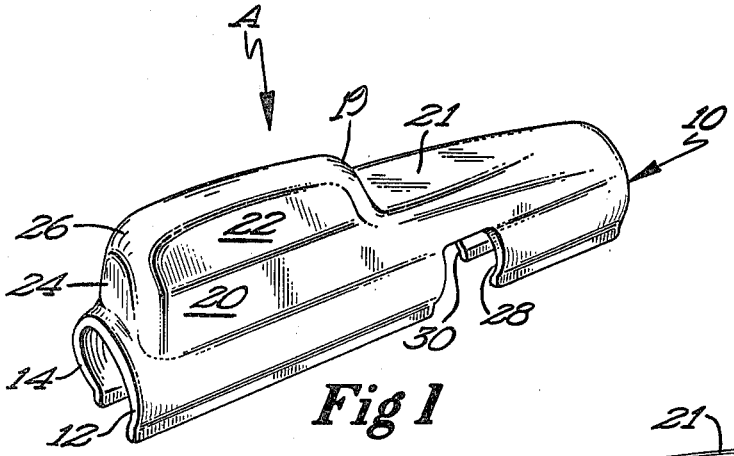
FIG. 1 is a perspective view of a gun sight cover embodying the invention.
Figure 2:
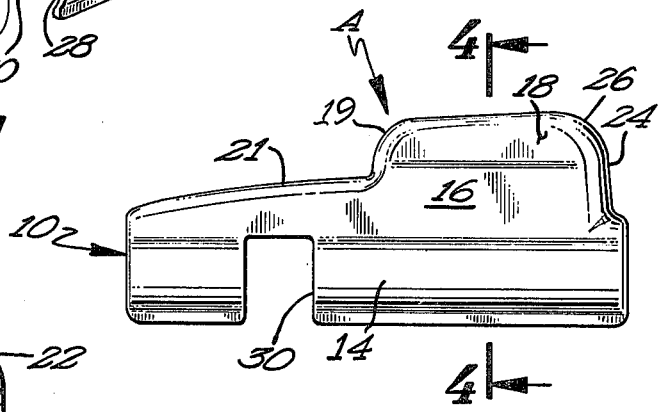
FIG. 2 is a side elevational view of the cover.
Figure 3:
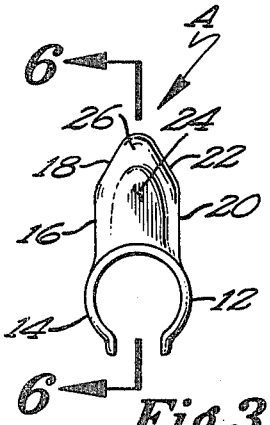
FIG. 3 is a front end view of the cover.
Figure 4:
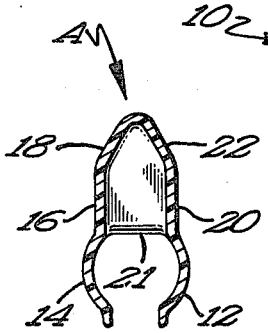
FIG. 4 is a sectional view on the line 4—4 of FIG. 2.

Referring to the drawings in detail, the one piece cover for a rifle sight A includes the substantially hollow body 10 open at the bottom which includes the lower elongated parallely disposed first and second sidewall portions 12 and 14 each of which is arcuate transversely inwardly of the body, to form clamping members for a gun barrel B. The clamping members encompass about 190° about the barrel. The lower edges of the sidewalls are spaced and the upper edge of the lower sidewall 14 terminates in a first substantially flat upper elongated sidewall portion 16 which in turn terminates in the enlarged foreward wall portion 18 which is angularly disposed inwardly of the vertical axis of the body, particularly FIG. 4.

The lower sidewall portion 12 terminates in the substantially flat elongated sidewall portion 20 which in turn terminates in the enlarged forward wall portion 22 which is angularly disposed inwardly of the vertical axis of the body and it joins the enlarged sidewall portion 18 at the upper edge.

The wall portions 16 and 20 at substantially the rear half portions join at the upper edges thereof as at top portion 21. Further, the forward ends of the enlarged forward wall portions 18 and 22 terminates in the end wall 24 at the arcuate portion 26 thereof.

Figure 5:
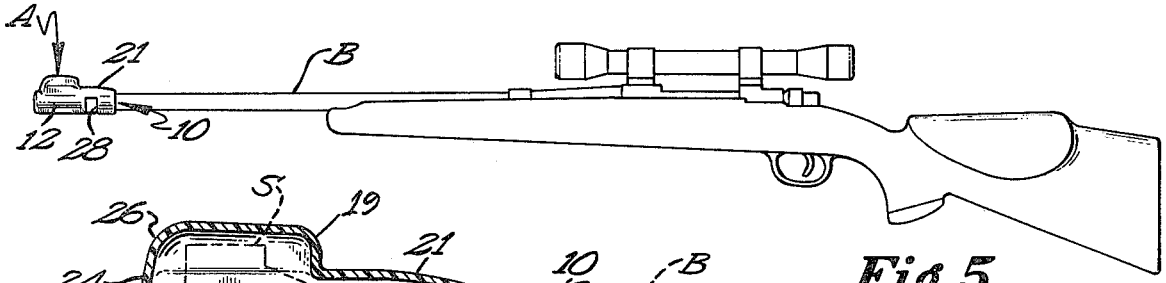
FIG. 5 is a side elevational view of a rifle with the cover in operative position on the barrel thereof.
Figure 6:
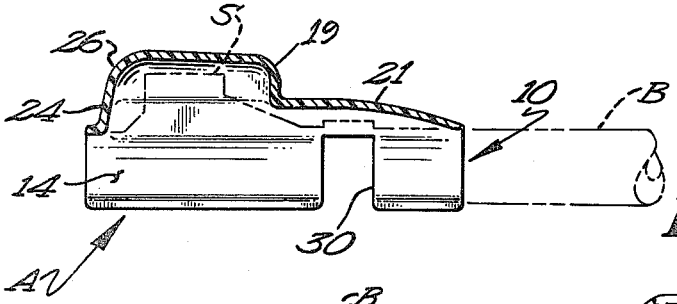
FIG. 6 is a partial longitudinal sectional view of the cover on the line 6—6 of FIG. 3 and illustrated on the sight of a gun barrel.
Figure 7:
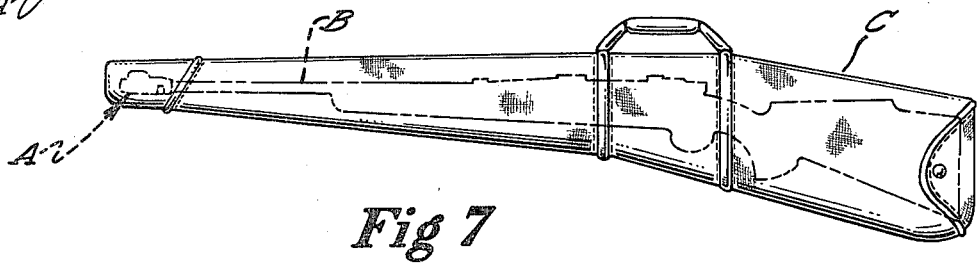
FIG. 7 is a side elevational view of a rifle gun case with a rifle therein in phantom with the cover upon the sight.

Each of the lower elongated sidewall portions 12 and 14 is formed with a notch 28 and 30 respectively, to allow a ring on certain rifle barrels to be positioned within the notch which prohibits the cover from sliding on the barrel. The sidewall portions 16 and 18 join an arcuate end wall 19 as illustrated in FIGS. 5 and 7.

In use of the cover A, the clamping lower sidewall portions 12 and 14 are forced over the gun barrel B at the area of the gun sight S with the sight upwardly within the cover with the clamping portions 12 and 14 in engagement with the underside of the barrel and the remainder of the cover covering the sight S. It will be seen that when the gun barrel with the cover on the sight is inserted into the gun case C, the arcuate portion 26 is passed upon the lining of the case and does not engage or tear the lining as the gun is slipped into the case due to the arcuate formation of the cover as at 26. Similarly, the arcuate rear portion 19 is passed upon the lining when the rifle is removed from the gun case whereby the lining is not torn. At the same time, the cover protects the sight on the barrel should the gun be dropped or mishandled when out of a case.

Having thus described the invention, what is claimed as new and desired to be secured by Letters Patent is:

1. One piece cover for a barrel-mounted gun sight for allowing the gun to be slipped into and out of a gun case without the gun sight tearing the inside of the gun case comprising, in combination: a substantially hollow elongated body open at the bottom including: a first lowermost wall portion arcuately formed transversely of the elongated body having a first end, a second end, a top edge, and a bottom edge; a second lowermost wall portion arcuately formed transversely of the elongated body having a first end, a second end, a top edge and a bottom edge; a first flat upper elongated sidewall portion having a bottom edge integrally formed with the top edge of the first lowermost wall portion, a top edge, a first end, and a second end, with the distance between the first end and the second end of the first flat upper elongated sidewall portion being less than the distance between the first end and the second end of the first lowermost wall portion; a second flat upper elongated sidewall portion having a bottom edge integrally formed with the top edge of the second lowermost wall portion, a top edge, a first end, and a second end, with the distance between the first end and the second end of the second flat upper elongated sidewall portion being less than the distance between the first end and the second end of the second lowermost wall portion; a first forward wall portion having a top edge, a bottom edge, a first end, and a second end, with the bottom edge of the first forward wall portion being attached to the top edge of the first flat upper elongated sidewall portion and disposed angularly inwardly of the vertical axis of the elongated body, with the distance between the first end and the second end of the first forward wall portion being generally equal to the distance between the first end and the second end of the first flat upper elongated sidewall portion; a second forward wall portion having a top edge, a bottom edge, a first end, and a second end, with the bottom edge of the second forward wall portion being attached to the top edge of the second flat upper elongated sidewall portion and disposed angularly inwardly of the vertical axis of the elongated body, with the distance between the first end and the second end of the second forward wall portion being generally equal to the distance between the first end and the second end of the second flat upper elongated sidewall portion, with the top edge of the first forward wall portion being attached to the top edge of the second forward wall portion; a first end wall, with the first ends of the first flat upper elongated sidewall portion, the second flat upper elongated sidewall portion, the first forward wall portion, and the second flat forward wall portion being attached to the first end wall along an arcuate portion; a top portion having a first end, a second end, a first edge, and a second edge, with the first edge being attached to the top edge of the first lowermost wall portion, with the second edge of the top portion being attached to the top edge of the second lowermost wall portion, with the first end of the top portion being generally co-planar with the second ends of the first and second lowermost wall portions; a second end wall having an arcuate shape, with the second ends of the first flat upper elongated sidewall portion, the second flat upper elongated sidewall portion, the first forward wall portion, the second forward wall portion, and the top portion being attached to the second end wall; a first notch formed in the first lowermost wall portion between the first and second ends of the top portion; a second notch formed in the second lowermost wall portion between the first and second ends of the top portion, with the first and second lowermost wall portions being spaced for clamping engagement of the gun barrel, with the first and second notches allowing positioning on a ring formed on the gun barrel and for prohibiting the elongated body from sliding on the gun barrel.

* * * * *